US006746507B2

(12) United States Patent
Shinkai et al.

(10) Patent No.: US 6,746,507 B2
(45) Date of Patent: Jun. 8, 2004

(54) PRODUCTION METHOD OF COMPOSITE MATERIAL AND COMPOSITE MATERIAL PRODUCED BY THE PRODUCTION METHOD

(75) Inventors: Masayuki Shinkai, Aichi-prefecture (JP); Masahiro Kida, Aichi-prefecture (JP); Takahiro Ishikawa, Nagoya (JP); Toshimasa Ochiai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 148 days.

(21) Appl. No.: 10/105,724

(22) Filed: Mar. 25, 2002

(65) Prior Publication Data

US 2003/0059331 A1 Mar. 27, 2003

(30) Foreign Application Priority Data

Mar. 29, 2001 (JP) ..... 2001-096250
Mar. 19, 2002 (JP) ..... 2002-076785

(51) Int. Cl.[7] ..... B22F 1/00; B22F 1/02; B22F 3/26; C22C 1/05

(52) U.S. Cl. ..... 75/230; 419/10; 419/35; 419/27; 75/249

(58) Field of Search ..... 75/230, 249; 419/10, 419/27, 35

(56) References Cited

U.S. PATENT DOCUMENTS 3,407,061 A * 10/1968 Hutkin ..... 419/54
4,327,156 A * 4/1982 Dillon et al. ..... 428/568
4,889,686 A * 12/1989 Singh et al. ..... 156/89.25
5,288,670 A * 2/1994 Kelsey ..... 501/96.3
6,033,622 A * 3/2000 Maruyama ..... 419/35
6,599,466 B1 * 7/2003 Moxson et al. ..... 419/27

FOREIGN PATENT DOCUMENTS

JP 2609376 2/1997
JP 9-227969 9/1997

OTHER PUBLICATIONS

"$Ni_3Al/Al_2O_3$ Composites with Interpenetrating Networks", Rodel et al., *Scripta Metallurgica et Materiala,* vol. 33, No. 5, pp.843–848, 1995.

"Effect of SiC and $ZrO_2$ Particles on the Mechanical Properties of NiA1", Plazanet et al., *Composites Science and Technology 59* (1999)pp.537–542.

* cited by examiner

*Primary Examiner*—Daniel Jenkins
(74) *Attorney, Agent, or Firm*—Burr & Brown

(57) ABSTRACT

There are disclosed a method for producing a composite material composed of a dispersing agent and a matrix, and a composite material produced by the method. The matrix is formed by the steps of coating a metal-coated dispersing agent to form a metal-coated layer on the surface of the dispersing agent, filling the metal-coated dispersing agent in a jig prepared in a fixed shape, and then causing the reaction of the metal-coated layer with a molten Al by impregnating the metal-coated dispersing agent with the molten Al filled in the jig.

33 Claims, 5 Drawing Sheets

ABOUT 5 TO 10 μm PRODUCT

BELOW 1 μm PRODUCT

ABOUT 5 TO 10 μm PRODUCT

PRODUCTION METHOD OF COMPOSITE MATERIAL AND COMPOSITE MATERIAL PRODUCED BY THE PRODUCTION METHOD

This application claims the benefit of Japanese Application 2001-096250, filed Mar. 29, 2001, and Japanese Application 2002-076785, filed Mar. 19, 2002, the entireties of which are incorporated herein by reference.

BACKGROUND OF THE INVENTION AND RELATED ART STATEMENT

The present invention relates to a production method of a composite material composed of a dispersing agent and a matrix and to a composite material produced by the production method.

A composite material is a composition aggregate in which plural raw materials are macroscopically mixed to provide characteristics, which a raw material alone could not realize, by complementarily utilizing mechanical properties that each raw material possesses. Basically, the method of producing a composite material is a technical method by which a material is combined with other material, and there are various combinations depending on matrixes and dispersing agents, intended purposes, or cost and the like.

Among them, metal matrix composites and intermetallic matrix composites are composite materials that are made by using a metal like Al, Ti, Ni, Nb and others, or an intermetallic compound like TiAl, $Ti_3Al$, $Al_3Ti$, NiAl, $Ni_3Al$, $Ni_2Al_3$, $Al_3Ni$, $Nb_3Al$, $Nb_2Al$, $Al_3Nb$ and others as a matrix and using an inorganic material like ceramics and others as a dispersing agent. Accordingly, metal matrix composites and intermetallic matrix composites are materials intended for use in the aerospace field and the automobile industry by making the best use of their properties of light weight and high strength, and especially metal matrix composites, in recent years, are contemplated to utilize in many fields, including electronics represented by electronic devices, by making the best use of the properties of low thermal expansion and high thermal conduction.

Production methods of intermetallic compound-based composite material include a method in which intermetallic compound powder is produced by mechanical alloying (MA) and the like in advance, and then the powder is hot-pressed (HP) or hot isostatic-pressed (HIP) with fibers and/or particles as dispersing agent under the conditions of high temperature and high pressure. And, production methods of metal-based composite material include solid state fabrication techniques like a method in which materials are hot-pressed (HP) or hot isostatic-pressed (HIP) under the conditions of high temperature and high pressure, and liquid phase methods like a pressurized impregnation method in which a molten metal is impregnated and a squeeze casting method in which high pressure is needed.

SUMMARY OF THE INVENTION

As problems in the conventional production methods for producing metal matrix composites and intermetallic matrix composites, in order to produce fine composite materials, not only do fine matrixes need to be formed by loading high temperature and high pressure in production methods of hot-pressing, hot isostatic-pressing and the like but the performance and scale of production equipment are restricted, consequently there are such problems that it is extremely difficult to produce large-sized or complex-shaped composite materials, in addition, it is impossible to perform a near net shaping in consideration of the shape of an end product, and mechanical processing treatment is needed in a later process.

Further, as a pretreatment process in the production of an intermetallic compound-based composite material, a process is needed to synthesize intermetallic compound powder by mechanical alloying and the like in advance, accordingly there is such a problem that the production process has multiple stages and is complicated. As a result, as described above, the conventional method of producing metal matrix composites and intermetallic matrix composites is an extremely high cost production method because not only does the method need a multistage process but it is carried out under high temperature and high pressure.

In order to solve these problems, Japanese Patent Publication No. 2609376 and Japanese Patent Application Laid-Open No. 9-227969 disclose production methods of composite materials in which methods using a preform composed of a metal oxide and others that can be reduced with Al and the like, the preform is made to react with liquid Al and the like in the surface layer to synthesize aluminide intermetallic compounds and oxides (especially $Al_2O_3$) in-situ synthesis.

However, according to the production methods disclosed in Japanese Patent Publication No. 2609376 and Japanese Patent Application Laid-Open No. 9-227969, because the kinds of dispersing agents to be dispersed in obtained composite materials are limited, intended material designs are limited to some specific combinations and it becomes difficult to change the properties of composite materials. Further, the methods have such a problem that if the ratio of materials to be used is not strictly controlled, metal oxides and others or Al and others may remain. Moreover, since a large quantity of reaction heat is generated in a moment, there may be some cases where reaction control is difficult.

On the other hand, among composite materials, porous composite materials having a lot of pores (hereinafter described as "porous composite materials") exhibits various kinds of effect due to as well as being light compared to composite materials having fine microstructures (hereinafter described as "fine composite materials"). In addition, in the case that pores are introduced into the matrix, generally, mechanical properties such as strength, Yong's modulus and the like decrease though the material becomes lighter as its porosity increases.

Further, up to now some trials have been performed to make obtained porous composite materials light by making hollow particles compound with a metal of Al or the like, and there has been mainly employed as a production process a pressurized impregnation method in which operations under pressure are required when a metal of Al or the like is impregnated into gaps among hollow particles. According to the pressurized impregnation method, however, there are such problems that crushing, breaking or the like are easily caused in hollow particles when a metal of Al or the like is impregnated. That is, hollow particles are broken due to static pressure of a molten metal in the case that a higher pressure is applied to the molten metal to impregnate it into the gaps, and the molten metal occupies the inner portions of the broken hollow particles. This results in failure to lightening the product. On the other hand, however, the gaps among the hollow particles will not be fulfilled sufficiently with the molten metal, in the case that a pressure for impregnating the molten metal into the gaps is reduced so as not to break the hollow particles. This results in the formation of internal defects, such as cavities. Consequently, there are some cases that expected properties, e.g., light weight are not given to obtained composite materials or that the improvements in the specific strength, specific elasticity, and the like were not achieved.

The present invention has been done in view of these problems associated with conventional arts and aims at providing a production method and composite materials produced by the production method, which production method reduces and simplifies the production processes and at the same time, produces a metal-based composite material, an intermetallic compound-based composite material, and a composite material in a state in which a metal and an intermetallic compound are mixed is used as a matrix, which composite materials are also applicable to large-sized and complex-shaped end products.

That is, according to the present invention, there is provided a production method of a composite material composed of a dispersing agent and a matrix, which comprises: forming a metal-coated layer on the surface of said dispersing agent to prepare a metal-coated dispersing agent, filling said metal-coated dispersing agent in a jig prepared in a fixed shape, and then causing the reaction of said metal-coated layer with molten Al by impregnating said filled metal-coated dispersing agent with said molten Al to form said matrix.

In the present invention, it is preferable that a metal-coated layer that is composed of Ni and has the thickness of below 1% with respect to the average particle size of the dispersing agent is formed using below 4 mass % of Ni with respect to the total amount of molten Al and Ni, and whole the matrix is made of Al. And it is also preferable that a metal-coated layer that is composed of Ni and has the thickness of 1% or more to below 8% with respect to the average particle size of the dispersing agent is formed using 4 mass % or more to below 42 mass % of Ni with respect to the total amount of molten Al and Ni, and whole the matrix is made of a mixture of Al and an aluminide intermetallic compound. Similarly, it is also preferable that a metal-coated layer that is composed of Ni and has the thickness of 8% or more to 24% or less with respect to the average particle size of the dispersing agent is formed using 42 mass % or more to 87.8 mass % or less of Ni with respect to the total amount of molten Al and Ni, and whole the matrix is made of an aluminide intermetallic compound.

On the other hand, in the present invention, it is preferable that a metal-coated layer that is composed of Ti and has the thickness of below 1% with respect to the average particle size of the dispersing agent is formed using below 2 mass % of Ti with respect to the total amount of molten Al and Ti, and whole the matrix is made of Al. And it is also preferable that a metal-coated layer that is composed of Ti and has the thickness of 1% or more to below 12% with respect to the average particle size of the dispersing agent is formed using 2 mass % or more to below 36.5 mass % of Ti with respect to the total amount of molten Al and Ti, and whole the matrix is made of a mixture of Al and an aluminide intermetallic compound. Similarly, it is also preferable that a metal-coated layer that is composed of Ti and has the thickness of 12% or more to 25% or less with respect to the average particle size of the dispersing agent is formed using 36.5 mass % or more to 86 mass % or less of Ti with respect to the total amount of molten Al and Ti, and whole the matrix is made of an aluminide intermetallic compound.

Further, in the present invention, it is preferable that a metal-coated layer that is composed of Nb and has the thickness of below 1% with respect to the average particle size of the dispersing agent is formed using below 4 mass % of Nb with respect to the total amount of molten Al and Nb, and whole the matrix is made of Al. And it is also preferable that a metal-coated layer that is composed of Nb and has the thickness of 1% or more to below 12% with respect to the average particle size of the dispersing agent is formed using 4 mass % or more to below 53 mass % of Nb with respect to the total amount of molten Al and Nb, and whole the matrix is made of a mixture of Al and an aluminide intermetallic compound. Similarly, it is also preferable that a metal-coated layer that is composed of Nb and has the thickness of 12% or more to 25% or less with respect to the average particle size of the dispersing agent is formed using 53 mass % or more to 92.4 mass % or less of Nb with respect to the total amount of molten Al and Nb, and whole the matrix is made of an aluminide intermetallic compound.

In the present invention, it is preferable to form the metal-coated film by any method of electroless plating, CVD (chemical vapor deposition), ion plating as PVD (physical vapor deposition), sputtering, or vacuum evaporation.

On the other hand, according to the present invention, there is provided a production method of a composite material that is composed of a dispersing agent and a matrix, which comprises: forming a metal oxide-coated layer on a surface of said dispersing agent to prepare a metal oxide-coated dispersing agent, filling said metal oxide-coated dispersing agent in a jig prepared in a fixed shape, and then causing the reaction of said metal oxide-coated layer with molten Al by impregnating said filled metal oxide-coated dispersing agent with said molten Al to form said matrix.

In the present invention, it is preferable to use as a dispersing agent any one of inorganic materials of fibers, particles, whiskers, hollow particles, porous bodies with open pores, or porous bodies with closed pores, and further it is preferable to use hollow particles of 0.1 to 30 $\mu$m in shell thickness. Moreover, it is preferable to use any inorganic material of $Al_2O_3$, AlN, SiC, or $Si_3N_4$.

In the present invention, it is preferable to make the volume percentage of a dispersing agent in a composite material to be 20 to 80%. On the other hand, after a metal-coated dispersing agent has been prepared, prior to filling the metal-coated dispersing agent into a jig, it is preferable to mix metal powder with the metal-coated dispersing agent. And it is preferable to use metal powder having particle size at the rate of 0.05 to 80% with respect to the average particle size of the dispersing agent.

On the other hand, according to the present invention, there is provided a composite material comprising a dispersing agent and a matrix, wherein a metal-coated dispersing agent is prepared by forming a metal-coated layer on the surface of said dispersing agent, said metal-coated dispersing agent is filled in a jig prepared in a fixed shape, and the reaction of said metal-coated layer with molten Al is caused by impregnating said filled metal-coated dispersing agent with said molten Al to form said matrix.

In the present invention, it is preferable that the metal-coated layer is Ni, the amount of Ni used is below 4 mass % with respect to the total amount of molten Al and Ni, the thickness of the metal-coated layer is below 1% with respect to the average particle size of the dispersing agent, and whole the matrix is Al. And it is also preferable that the amount of Ni used is 4 mass % or more to below 42 mass % with respect to the total amount of molten Al and Ni, the thickness of the metal-coated layer is 1% or more to below 8% with respect to the average particle size of the dispersing agent, and whole the matrix is a mixture of Al and an aluminide intermetallic compound. Similarly, it is also preferable that the amount of Ni used is 42 mass % or more to 87.8 mass % or less with respect to the total amount of molten Al and Ni, the thickness of the metal-coated layer is 8% or more to 26% or less with respect to the average particle size of the dispersing agent, and whole the matrix is an aluminide intermetallic compound.

On the other hand, in the present invention, it is preferable that the metal-coated layer is Ti, the amount of Ti used is below 2 mass % with respect to the total amount of molten Al and Ti, the thickness of the metal-coated layer is below 1% with respect to the average particle size of the dispersing agent, and whole the matrix is Al. And it is also preferable that the amount of Ti used is 2 mass % or more to below 36.5 mass % with respect to the total amount of molten Al and Ti, the thickness of the metal-coated layer is 1% or more to below 12% with respect to the average particle size of the dispersing agent, and whole the matrix is a mixture of Al and an aluminide intermetallic compound. Similarly, it is also preferable that the amount of Ti used is 36.5 mass % or more to 86 mass % or less with respect to the total amount of molten Al and Ti, the thickness of the metal-coated layer is to 12% or more to 25% or less with respect to the average particle size of the dispersing agent, and whole the matrix is an aluminide intermetallic compound.

Further, in the present invention, it is preferable that the metal-coated layer is Nb, the amount of Nb used is below 4 mass % with respect to the total amount of molten Al and Nb, the thickness of the metal-coated layer is below 1% with respect to the average particle size of the dispersing agent, and whole the matrix is Al. And it is also preferable that the amount of Nb used is 4 mass % or more to below 53 mass % with respect to the total amount of molten Al and Nb, the thickness of the metal-coated layer is 1% or more to below 12% with respect to the average particle size of the dispersing agent, and whole the matrix is a mixture of Al and an aluminide intermetallic compound. Similarly, it is also preferable that the amount of Nb used is 53 mass % or more to 92.4 mass % or less with respect to the total amount of molten Al and Nb, the thickness of the metal-coated layer is 12% or more to 25% or less with respect to the average particle size of the dispersing agent, and whole the matrix is an aluminide intermetallic compound.

On the other hand, according to the present invention, there is provided a composite material comprising a dispersing agent and a matrix, wherein a metal oxide-coated dispersing agent is prepared by forming a metal oxide-coated layer on the surface of said dispersing agent, said metal oxide-coated dispersing agent is filled in a jig prepared in a fixed shape, and the reaction of said metal oxide-coated layer with molten Al is caused by impregnating said filled metal oxide-coated dispersing agent with said molten Al to form said matrix.

In the present invention, it is preferable that a dispersing agent is any one of inorganic materials of fibers, particles, whiskers, hollow particles, porous bodies with open pores, or porous bodies with closed pores, and further it is preferable that the shell thickness of hollow particles is 0.1 to 30 $\mu$m. Moreover, it is preferable that the above described inorganic material is any of $Al_2O_3$, AlN, SiC, or $Si_3N_4$.

In the present invention, it is preferable that the volume percentage of a dispersing agent in a composite material is 20 to 80%. On the other hand, after a metal-coated dispersing agent has been prepared, prior to filling the metal-coated dispersing agent into a jig, it is preferable that metal powder is mixed with the above described metal-coated dispersing agent. And it is preferable that the average particle size of the above described metal powder is at the rate of 0.05 to 80% with respect to the average particle size of the dispersing agent.

DETAILED DESCRIPTION OF PREFERRED EMBODIMENT

Figure 1:
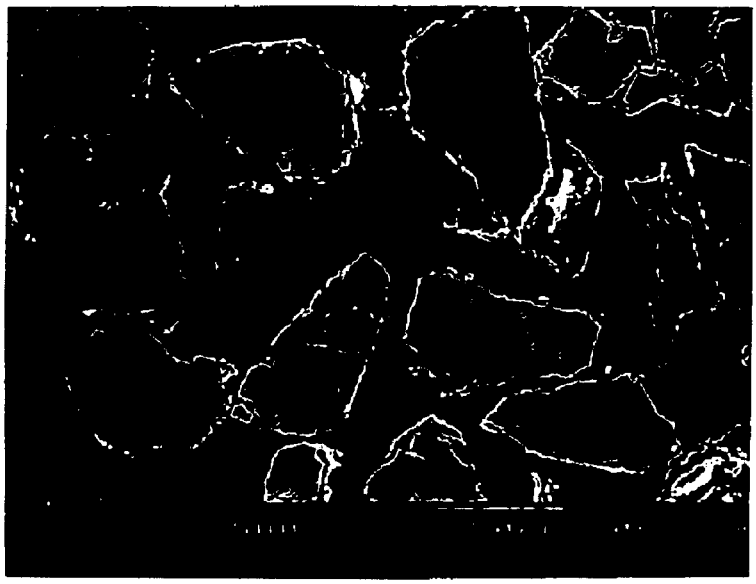
FIG. 1 is a scanning electron microphotograph showing the microstructure of $Al_2O_3$ particles (ground particles) of dispersing agents.

In the following, the present invention will be described in detail with regard to embodiments, but the present invention should not be limited to these embodiments.

The first aspect of the present invention is the production method of a composite material that is composed of a dispersing agent and a matrix and relates to a production method that is characterized in that a metal-coated layer is formed on the surface of a dispersing agent in advance, the obtained metal-coated dispersing agent is filled in a jig prepared in a fixed shape, then the reaction of the metal-coated layer with molten Al is caused by impregnating the filled metal-coated dispersing agent with molten Al to form a matrix in-situ synthesis. That is, because the formation of a matrix is progressed by reactions like a self-combustion reaction and others, it is possible to produce a composite material by non-pressurized infiltration without relying on such conditions imposed in case of producing a composite material by HP (hot press) or HIP (hot isostatic-press) as conventional production methods. In the following, the details will be further described.

In the present invention, the inner part of the reaction system is held at high temperature in a moment by the reaction of molten Al with the metal-coated layer. For this reason, molten Al is penetrated into gaps in a dispersing agent without being pressurized while causing the reaction, as a result, a fine composite material can be produced without loading high pressure. Therefore, it will be possible to produce a composite material having large-sized and/or complicated shape, which production was difficult because of the performance of the production equipment.

For example, a metal-coated layer is formed on the surface of a dispersing agent using any of Ni, Ti or Nb to prepare the metal-coated dispersing agent, and after that, when the metal-coated dispersing agent is impregnated with molten Al, the molten Al reacts with the metal-coated layer, resulting in the improvement of the wettability of molten Al to the dispersing agent. Representative examples of the reactions in this case will be shown in the following formulas (expression 1 to expression 3).

$$3Al+Ni \rightarrow Al_3Ni:\Delta H_{298}=-150\ kJ/mol \quad \text{[Expression 1]}$$

wherein ΔH denotes reaction heat of formation (when ΔH<0, exothermic reaction)

$$3Al+Ti \rightarrow Al_3Ti:\Delta H_{298}=-146\ kJ/mol \quad \text{[Expression 2]}$$

wherein ΔH denotes reaction heat of formation (when ΔH<0, exothermic reaction)

$$3Al+Nb \rightarrow Al_3Nb:\Delta H_{298}=-160\ kJ/mol \quad \text{[Expression 3]}$$

wherein ΔH denotes reaction heat of formation (when ΔH<0, exothermic reaction)

As shown in the above expressions, reactions at this time are exothermic reactions accompanying the heat of formation of compounds, and in the production method of the present invention, the formation of a composite material is promoted by utilizing this reaction heat. Consequently, because the conditions of high temperature and high pressure, which were necessary to produce a finer composite material in HP (hot press) and the like, become unnecessary, it becomes possible to produce a composite material having large-sized and/or complicated shape, which production was difficult because of the performance of production equipment.

Furthermore, when the thickness of a metal-coated layer that covers a dispersing agent and the amount of a metal to be used are strictly prescribed, it is possible to control the composition of a matrix to be formed around the dispersing agent. That is, it is possible to use Al as the main component of the matrix, to make the matrix of a mixture of Al and an intermetallic compound, or to make whole the matrix of an aluminide intermetallic compound, and a proper matrix may be selected in response to the purpose of using a producible composite material and others accordingly.

Further, being different from the production methods disclosed in Japanese Patent Publication No. 2609376 and Japanese Patent Application Laid-Open No. 9-227969, only a matrix can be synthesized in situ. Accordingly, any kind of a dispersing agent can be freely selected, and it is possible to optionally select a composite material having desired properties and to produce a composite material having desired physical properties.

Moreover, because it is easy to control reaction heat by optionally selecting and setting the kind of a dispersing agent and the amount used, the production method of the present invention can be applied to the industrial production process of a composite material.

In the present invention, it is preferable that a metal-coated layer that is composed of Ni and has the thickness of below 1% with respect to the average particle size of the dispersing agent is formed using below 4 mass % of Ni with respect to the total amount of molten Al and Ni, and whole the matrix to be formed by reaction is made of Al. Further, the amount of Ni used is more preferably below 3.5 mass % and is especially preferably below 3 mass % with respect to the total amount of molten Al and Ni. And, the thickness of the metal-coated layer is more preferably below 0.8% and is especially preferably below 0.7% with respect to the average particle size of the dispersing agent.

When a metal-coated layer that is composed of Ni and has the thickness of 1% or more with respect to the average particle size of the dispersing agent is formed using Ni in an amount of 4 mass % or more with respect to the total amount of molten Al and Ni, the residual content of an intermetallic compound formed from Ni and Al is approximately 1.0% or more in volume percentage in the matrix, which is not preferable because it becomes difficult to make the whole matrix of uniform Al. Furthermore, in order to utilize reaction heat, which is a feature of the present invention, it will be sufficient to use Ni in an amount of 1 mass % or more with respect to the total amount of molten Al and Ni, and to have the thickness of the metal-coated layer to be 0.28% or more with respect to the average particle size of the dispersing agent.

Moreover, the phrase "make whole the matrix of Al" used in the present invention means that whole the matrix is positively made of Al by controlling the thickness and amount of the metal-coated layer in the surface of a dispersing agent. However, in this case, some amount of an intermetallic compound phase that is inevitably formed is mixed in Al constituting the matrix, but if the rate of the phase accounting for the matrix is approximately 3% or less in volume percentage, it is determined that whole the matrix is made of Al.

It is preferable that a metal-coated layer that is composed of Ni and has the thickness of 1% or more to below 8% with respect to the average particle size of the dispersing agent is formed using 4 mass % or more to below 42 mass % of Ni with respect to the total amount of molten Al and Ni, and whole the matrix to be formed by reaction is made of a mixture of Al and an aluminide intermetallic compound. Further, the amount of Ni used is more preferably 6 to 40 mass % and is especially preferably 8 to 38 mass % with respect to the total amount of molten Al and Ni. And, the thickness of the metal-coated layer is more preferably 2 to 7% and is especially preferably 3 to 6% with respect to the average particle size of the dispersing agent.

When a metal-coated layer that is composed of Ni and has the thickness of below 1% with respect to the average particle size of the dispersing agent is formed using Ni in an amount of below 4 mass % with respect to the total amount of molten Al and Ni, which is not preferable because it becomes difficult to make whole the matrix of a mixture of Al and an aluminide intermetallic compound. On the other hand, when a metal-coated layer that is composed of Ni and has the thickness of 8% or more with respect to the average particle size of the dispersing agent is formed using Ni in an amount of 42 mass % or more with respect to the total amount of molten Al and Ni, which is also not preferable because it becomes difficult to make whole the matrix of a mixture of Al and an aluminide intermetallic compound.

Moreover, the phrase "make whole the matrix of a mixture of Al and an aluminide intermetallic compound" used in the present invention means that whole the matrix is positively made to be a mixed state of Al and an aluminide intermetallic compound by controlling the thickness and amount of the metal-coated layer in the surface of a dispersing agent.

It is preferable that a metal-coated layer that is composed of Ni and has the thickness of 8% or more to 26% or less with respect to the average particle size of the dispersing agent is formed using 42 mass % or more to 87.8 mass % or less of Ni with respect to the total amount of molten Al and Ni, and whole the matrix to be formed by reaction is made of an aluminide intermetallic compound. Further, the amount of Ni used is more preferably 45 to 85 mass % and is especially preferably 48 to 83 mass % with respect to the total amount of molten Al and Ni. And, the thickness of the metal-coated layer is more preferably 10 to 24% and is especially preferably 12 to 22% with respect to the average particle size of the dispersing agent.

When a metal-coated layer that is composed of Ni and has the thickness of below 8% with respect to the average particle size of the dispersing agent is formed using Ni in an amount of below 42 mass % with respect to the total amount of molten Al and Ni, which is not preferable because it becomes difficult to make whole the matrix of an aluminide intermetallic compound. On the other hand, when a metal-coated layer that is composed of Ni and has the thickness of over 26% with respect to the average particle size of the dispersing agent is formed using Ni in an amount of over 87.8 mass % with respect to the total amount of molten Al and Ni, which is not preferable because it becomes difficult to make whole the matrix of an aluminide intermetallic compound and metal that should be the metal-coated layer remains in the matrix in a large quantity, particularly over 5% in terms of the volume percentage.

Here, the composite material can be applied without difficulty to take aim at improving the brittle behavior as one of features of intermetallic compounds by making some metal-coated layers remain, if the amount of metals remaining in the matrix is 5% or less in terms of the volume percentage.

Moreover, the phrase "make whole the matrix of an aluminide intermetallic compound" used in the present invention means that whole the matrix is positively made of an aluminide intermetallic compound by controlling the thickness and amount of the metal-coated layer in the surface of a dispersing agent. However, in this case, it is also supposed that some metals that should be the metal-coated layer, which metals inevitably remain, are mixed in the aluminide intermetallic compound constituting the matrix, but if the rate of the metals accounting for the matrix is approximately 3% or less in volume percentage, it is determined that whole the matrix is made of an aluminide intermetallic compound.

In the present invention, it is preferable that a metal-coated layer that is composed of Ti and has the thickness of below 1% with respect to the average particle size of the dispersing agent is formed using below 2 mass % of Ti with respect to the total amount of molten Al and Ti, and whole the matrix to be formed by reaction is made of Al. Further, the amount of Ti used is more preferably below 1.5 mass % and is especially preferably below 1 mass % with respect to the total amount of molten Al and Ti. And, the thickness of the metal-coated layer is more preferably below 0.9% and is especially preferably below 0.8% with respect to the average particle size of the dispersing agent.

When a metal-coated layer that is composed of Ti and has the thickness of 1% or more with respect to the average particle size of the dispersing agent is formed using Ti in an amount of 2 mass % or more with respect to the total amount of molten Al and Ti, the residual content of an intermetallic compound formed from Ti and Al is approximately 3% or more in volume percentage in the matrix, which is not preferable because it becomes difficult to make whole the matrix of uniform Al. Furthermore, in order to utilize reaction heat, which is a feature of the present invention, it will be sufficient to use Ti in an amount of 0.5 mass % or more with respect to the total amount of molten Al and Ti, and to have the thickness of the metal-coated layer to be 0.27% or more with respect to the average particle size of the dispersing agent.

It is preferable that a metal-coated layer that is composed of Ti and has the thickness of 1% or more to below 12% with respect to the average particle size of the dispersing agent is formed using 2 mass % or more to below 36.5 mass % of Ti with respect to the total amount of molten Al and Ti, and whole the matrix to be formed by reaction is made of a mixture of Al and an aluminide intermetallic compound. Further, the amount of Ti used is more preferably 4 to 34 mass % and is especially preferably 6 to 32 mass % with respect to the total amount of molten Al and Ti. And, the thickness of the metal-coated layer is more preferably 2 to 10% and is especially preferably 3 to 8% with respect to the average particle size of the dispersing agent.

When a metal-coated layer that is composed of Ti and has the thickness of below 1% with respect to the average particle size of the dispersing agent is formed using Ti in an amount of below 2 mass % with respect to the total amount of molten Al and Ti, which is not preferable because it becomes difficult to make whole the matrix of a mixture of Al and an aluminide intermetallic compound. On the other hand, when a metal-coated layer that is composed of Ti and has the thickness of 12% or more with respect to the average particle size of the dispersing agent is formed using Ti in an amount of 36.5 mass % or more with respect to the total amount of molten Al and Ti, which is also not preferable because it becomes difficult to make the whole matrix of a mixture of Al and an aluminide intermetallic compound.

It is preferable that a metal-coated layer that is composed of Ti and has the thickness of 12% or more to 25% or less with respect to the average particle size of the dispersing agent is formed using 36.5 mass % or more to 86 mass % or less of Ti with respect to the total amount of molten Al and Ti, and whole the matrix to be formed by reaction is made of an aluminide intermetallic compound. Further, the amount of Ti used is more preferably 38 to 84 mass % and is especially preferably 40 to 82 mass % with respect to the total amount of molten Al and Ti. And, the thickness of the metal-coated layer is more preferably 14 to 23% and is especially preferably 16 to 20% with respect to the average particle size of the dispersing agent.

When a metal-coated layer that is composed of Ti and has the thickness of below 12% with respect to the average particle size of the dispersing agent is formed using Ti in an amount of below 36.5 mass % with respect to the total amount of molten Al and Ti, which is not preferable because it becomes difficult to make whole the matrix of an aluminide intermetallic compound. On the other hand, when a metal-coated layer that is composed of Ti and has the thickness of over 25% with respect to the average particle size of the dispersing agent is formed using Ti in an amount of over 86 mass % with respect to the total amount of molten Al and Ti, which is not preferable because it becomes difficult to make whole the matrix of an aluminide intermetallic compound and metal that should be the metal-coated layer remains in the matrix in a large quantity, particularly over 5% in terms of the volume percentage.

Here, the composite material can be applied without difficulty to take aim at improving the brittle behavior as one of features of intermetallic compounds by making some metal-coated layers remain, if the amount of metals remaining in the matrix is 5% or less in terms of the volume percentage.

In the present invention, it is preferable that a metal-coated layer that is composed of Nb and has the thickness of below 1% with respect to the average particle size of the dispersing agent is formed using below 4 mass % of Nb with respect to the total amount of molten Al and Nb, and whole the matrix to be formed by reaction is made of Al. Further, the amount of Nb used is more preferably below 3.5 mass % and is especially preferably below 3 mass % with respect to the total amount of molten Al and Nb. And, the thickness of the metal-coated layer is more preferably below 0.8% and is especially preferably below 0.7% with respect to the average particle size of the dispersing agent.

When a metal-coated layer that is composed of Nb and has the thickness of 1% or more with respect to the average particle size of the dispersing agent is formed using Nb in an amount of 4 mass % or more with respect to the total amount of molten Al and Nb, the residual content of an intermetallic compound formed from Nb and Al is approximately 3% or more in volume percentage in the matrix, which is not preferable because it becomes difficult to make whole the matrix of uniform Al. Furthermore, in order to utilize reaction heat, which is a feature of the present invention, it will be sufficient to use Nb in an amount of 0.9 mass % or more with respect to the total amount of molten Al and Nb, and to have the thickness of the metal-coated layer to be 0.26% or more with respect to the average particle size of the dispersing agent.

It is preferable that a metal-coated layer that is composed of Nb and has the thickness of 1% or more to below 12% with respect to the average particle size of the dispersing agent is formed using 4 mass % or more to below 53 mass % of Nb with respect to the total amount of molten Al and Nb, and whole the matrix to be formed by reaction is made of a mixture of Al and an aluminide intermetallic compound. Further, the amount of Nb used is more preferably 6 to 50 mass % and is especially preferably 8 to 48 mass % with respect to the total amount of molten Al and Nb. And, the thickness of the metal-coated layer is more preferably 2 to 11% and is especially preferably 3 to 10% with respect to the average particle size of the dispersing agent.

When a metal-coated layer that is composed of Nb and has the thickness of below 1% with respect to the average particle size of the dispersing agent is formed using Nb in an amount of below 4 mass % with respect to the total amount of molten Al and Nb, which is not preferable because it becomes difficult to make whole the matrix of a mixture of Al and an aluminide intermetallic compound. On the other hand, when a metal-coated layer that is composed of Nb and has the thickness of 12% or more with respect to the average particle size of the dispersing agent is formed using Nb in an amount of 53 mass % or more with respect to the total amount of molten Al and Nb, which is also not preferable because it becomes difficult to make the whole matrix of a mixture of Al and an aluminide intermetallic compound.

It is preferable that a metal-coated layer that is composed of Nb and has the thickness of 12% or more to 25% or less with respect to the average particle size of the dispersing agent is formed using 53 mass % or more to 92.4 mass % or less of Nb with respect to the total amount of molten Al and Nb, and whole the matrix to be formed by reaction is made of an aluminide intermetallic compound. Further, the amount of Nb used is more preferably 55 to 90 mass % and is especially preferably 58 to 87 mass % with respect to the total amount of molten Al and Nb. And, the thickness of the metal-coated layer is more preferably 14 to 23% and is especially preferably 15 to 20% with respect to the average particle size of the dispersing agent.

When a metal-coated layer that is composed of Nb and has the thickness of below 12% with respect to the average particle size of the dispersing agent is formed using Nb in an amount of below 53 mass % with respect to the total amount of molten Al and Nb, which is not preferable because it becomes difficult to make whole the matrix of an aluminide intermetallic compound. On the other hand, when a metal-coated layer that is composed of Nb and has the thickness of over 25% with respect to the average particle size of the dispersing agent was formed using Nb in an amount of over 92.4 mass % with respect to the total amount of molten Al and Nb, which is not preferable because it becomes difficult to make whole the matrix of an aluminide intermetallic compound and metal that should be the metal-coated layer remains in the matrix in a large quantity, particularly over 5% in terms of the volume percentage.

Here, the composite material can be applied without difficulty aiming at improving the brittle behavior as one of features of intermetallic compounds by making some metal layers remain, if the amount of metals remaining in the matrix is 5% or less in terms of the volume percentage.

Here, when the physical properties of a composite material produced are watched carefully, to take one example, if the kind of a dispersing agent and the volume percentage of particles are the same, the more the content of Al in the matrix is, the higher the thermal conductivity, thermal expansion coefficients and fracture toughness values are. Further, when the kind of the dispersing agent is changed, the thermal conductivity will be higher in the order of $Si_3N_4$, AlN, SiC, and the thermal expansion coefficient will be higher in the order of $Si_3N_4$, SiC, and AlN. Consequently, according to the production method of the present invention, it is possible to easily produce a composite material having desired physical properties by suitably selecting the kinds and amounts of a dispersing agent, a metal and the like.

In the next place, the details of the present invention will be described by citing one example of the production method. First, a dispersing agent having a fixed shape is prepared, a metal-coated layer is formed on the surface of the above described dispersing agent by the fixed means. At this time, in the present invention, it is preferable to form the metal-coated film by any method of electroless plating, CVD (chemical vapor deposition), ion plating as PVD (physical vapor deposition), sputtering, or vacuum evaporation. By using these methods, the metal-coated layer can be set to a suitable thickness and it is also possible to properly control the kind of the matrix from that containing Al as a main component to that containing an aluminide intermetallic compound.

Moreover, according to the present invention, it provides a production method of a composite material that is composed of a dispersing agent and a matrix, and is characterized in that a metal oxide-coated layer is formed on the surface of the dispersing agent to prepare a metal oxide-coated dispersing agent, after the above described metal oxide-coated dispersing agent is filled in a jig prepared in a fixed shape, a reaction is caused between the metal oxide-coated layer and molten Al by impregnating the filled metal oxide-coated dispersing agent with the molten Al to form a matrix. That is, a composite material in which the matrix is synthesized in situ can also be produced by forming metal oxide-coated layer instead of the above-described metal-coated layer. Further, a metal oxide-coated layer used here may be a compound that has reactivity with Al to be impregnated, that is, a compound that can be reduced by Al.

Furthermore, in the present invention, it is preferable to use as a dispersing agent any one of inorganic materials of fibers, powder, whiskers, hollow particles, porous bodies with open pores, or porous bodies with closed pores. By using these inorganic materials, it is possible to produce a composite material having strength and features suitable for the applications of end products.

Still more, in the present invention, when hollow particles are used as dispersing agents, a composite material to be obtained can be made to have low density and be light, and can be provided with properties of excellent thermal insulation, impact absorption and others. Further, by properly adjusting the shell thickness of hollow particles, it is possible to improve the specific strength and specific elastic modulus of a composite material to be obtained and to reduce its thermal expansion coefficient. That is, a porous composite material produced with the introduction of pores usually tends to have low strength and Young's modulus. However, in the present invention, a porous composite material can be provided by using hollow particles having proper shell thickness as dispersing agents, in which porous composite material decrease in values of physical properties is restrained including strength and Young' modulus while maintaining the lightness, and specific strength and specific elastic modulus are improved.

Further, in the present invention, because molten Al is penetrated into metal-coated dispersing agent filled in a jig without being pressurized, problems of crushing, breaking and others are hardly caused in hollow particles, consequently, properties (light weight, high thermal insulation, high impact absorption and others) are provided that are expected in obtained porous composite material. Further, since it is possible to make a near net shape in consideration of the shape of an end product, the production processes can be reduced and the reduction in the production cost is achieved at the same time.

Further, as the above described hollow particles in the present invention, it is preferable to use hollow particles of 0.1 to 30 $\mu$m in shell thickness and it is more preferable to use hollow particles of 0.5 to 10 $\mu$m in shell thickness. It is not preferable to use hollow particles of below 0.1 $\mu$m in shell thickness because the strength and Young's modulus of a composite material to be obtained become low, and it is also not preferable to use hollow particles of over 30 $\mu$m in shell thickness because lightening is sometimes impeded. Moreover, as hollow particles to be used in the present invention, shirasu balloon, pearlite, glass balloon, fly ash, zirconia balloon, alumina balloon, carbon balloon and others can be listed.

And, in the present invention, it is preferable to use any of $Al_2O_3$, AlN, SiC, or $Si_3N_4$ as an inorganic material. A composite material will exhibit various properties by the combination of a matrix and a dispersing agent as its constituents. The representative properties of composite materials produced with the use of dispersing agents composed of various inorganic materials are shown in Table 1. It is possible to properly produce a composite material meeting the requirements of an application by selecting a dispersing agent from various inorganic materials like this.

TABLE 1

| Dispersing agents | Features of an intermetallic compound-based composite material produced using the following dispersing agents |
|---|---|
| $Al_2O_3$ | Oxidation resistance, High strength, Abrasion resistance, Low thermal expansion |
| AIN | Thermal conduction property, High strength, Abrasion resistance, Low thermal expansion |
| SiC | Thermal conduction property, Electric conductivity, High strength, Abrasion resistance, Low thermal expansion |
| $Si_3N_4$ | High strength, Abrasion resistance, Low thermal expansion |

Next, the above described metal-coated dispersing agent is filled in a fixed jig and Al (commercially available pure Al) is placed on the dispersing agent. Al to be used in this time is not limited to pure Al, Al of about 90% or more in purity can be used without any trouble and various kinds of Al alloys may be used. After that, the filled metal-coated dispersing agent is heated to about 700° C. that is some tens of degrees above the melting temperature of Al (about 660° C.) in a vacuum to make molten Al impregnate into gaps in the metal-coated dispersing agent. In this case, infiltration in capillary that is caused by the reaction of the metal-coated layer with molten Al will be induced and an intended matrix of the composite material is synthesized in a moment as a result. Because the synthesis itself of the matrix is completed in a very short time, particularly it takes only about several minutes.

Further, after the reaction is completed, in order to make the obtained matrix of the composite material homogenous and stable, the composite material may be kept at a state of being isothermal or heated if necessary. Though the temperature and time for keeping the composite material at this time will be somewhat influenced by material systems, the temperature is preferably from a temperature equal to the temperature at which the reaction was caused to a temperature of about 400 to 500° C. higher than that one, and the keeping time may be from about 30 minutes to several hours when occasion demands.

When whole the matrix in a composite material to be produced is made of an aluminide intermetallic compound, a metal that forms the above described molten Al to be impregnated and the metal-coated layer may be formulated so as to be an aluminide intermetallic compound composed of the composition based on Table 2. Concerning an aluminide intermetallic compound to be intended, for example, about Ti—Al system, since representatively three phases of $Al_3Ti$, TiAl, and $Ti_3Al$ from Al-rich side exist and these single phase materials or two phase materials can be obtained, it is possible to select an intermetallic compound that is to be a matrix according to the material properties to be needed. Making Al react with various kinds of metal powder according to the rate shown in Table 2 allows a matrix to be converted from Al of low melting point to an aluminide intermetallic compound of higher melting point.

TABLE 2

| Material series | Intermetallic compounds | Melting points (° C.) | Al compositions (mass %) |
|---|---|---|---|
| Al—Ni | $Al_3Ni$ | 854 | 58 |
| | $Ni_2Al_3$ | 1133 | 40–44.7 |
| | NiAl | 1638 | 23.5–36 |
| | $Ni_3Al$ | 1385 | 12.2–15 |
| Al—Ti | $Al_3Ti$ | 1350 | 62.5–63.5 |
| | TiAl | 1480 | 34–56.2 |
| | $Ti_3Al$ | 1180 | 14–23 |
| Al—Nb | $Al_3Nb$ | 1680 | 45–47 |
| | $Nb_2Al$ | 1940 | 12–17 |
| | $Nb_3Al$ | 2060 | 7.6–8.8 |

That is, not only does the process for preparing an aluminide intermetallic compound in advance become unnecessary, but it is possible to produce a composite material that does not cause the phenomena of decreasing strength in the melting point area of Al and others. Furthermore, concerning the replacement of Al with an aluminide intermetallic compound as the reaction proceeds, there will be no problem so long as the degradation of the property aspect, including lowering in strength due to microscopic residual Al, does not occur. Particularly, the use of a composite material will be allowed if no peak of residual Al is confirmed in X-ray diffraction analysis or in thermal analysis, including DTA (differential thermal analysis) that will be described later.

In the present invention, it is preferable to use a dispersing agent in a volume percentage accounting for 20 to 80% of a composite material as an end product, more preferably 25 to 75% and most preferably 30 to 70%. When the volume percentage is below 20%, the composite material cannot reveal enough strength, and when over 80%, there will be caused a problem in the impregnation of molten Al, and it becomes difficult to synthesize an aluminide intermetallic compound as a result. Consequently, the present invention is a production method that can be suitably adopted in view of the content ratio of a dispersing agent constituting a general composite material.

On the other hand, in the present invention, after a metal-coated dispersing agent has been prepared, prior to filling the above described metal-coated dispersing agent into a jig, it is preferable to mix metal powder with the above described metal-coated dispersing agent. Through this operation, a composite material can be easily produced in which the matrix is an aluminide intermetallic compound, and the volume percentage of dispersing agents is higher.

Still more, the average particle size of metal powder used at this time is preferably 0.05 to 80%, more preferably 10 to 70%, and especially preferably 20 to 60% with respect to the average particle size of dispersing agents. When the average particle size of metal powder is below 0.05% with respect to the average particle size of dispersing agents, it is difficult to obtain metal powder itself and the handling of such metal powder becomes inconvenient because the risk of dust explosion is accompanied, and when over 80%, the reaction activity cannot be raised sufficiently, and an intermetallic compound-based composite material to be formed cannot be made minute.

Moreover, "a dispersing agent of 10 to 150 $\mu$m in average particle size" described in the present invention means "particles of 10 to 150 $\mu$m in average particle size" when the dispersing agents are particle-like, and when the dispersing agents are not particle-like but fibers, whiskers or the like, it means "in the case where the ratio of the fiber length/the fiber diameter is below 150, fibers, whiskers or the like of 0.1 to 30 $\mu$m in fiber diameter", or "in the case where the ratio of the fiber length/the fiber diameter is 150 or more, fibers, whiskers or the like of 0.5 to 500 $\mu$m in fiber diameter."

On the other hand, the second aspect of the present invention relates to a composite material that is composed of a dispersing agent and a matrix, and is characterized in that a metal-coated dispersing agent is prepared by forming a metal-coated layer on the surface of the dispersing agent, the above described metal-coated dispersing agent is filled in a jig prepared in a fixed shape, and the reaction of the metal-coated layer with molten Al is caused by impregnating the filled metal-coated dispersing agent with the molten Al to form the matrix, and the composite material can be produced by the production method of a composite material in the present invention, which method has been described above.

Further, a composite material is provided which material is characterized in that when a metal oxide-coated layer is formed instead of the above described metal-coated layer, the reaction of the layer with molten Al is also caused to form the matrix.

EXAMPLES

In the following, the present invention will be described by giving examples, but it goes without saying that the present invention should not be limited to these examples at all.

Example 1

$Al_2O_3$ particles (ground particles) having the average particle size of 47 $\mu$m as dispersing agents and Ni that would become a metal-coated layer were prepared, and a metal-coated layer was formed on the surface of the dispersing agents by electroless plating treatment so that the volume percentage of the particles was 30 to 80 vol. % and the amount of the metal-coated layer was from over 4 to below 42 mass % to produce metal-coated dispersing agents (metal-coated particles).

Then, the above described metal-coated particles were filled in a fixed jig, onto which Al (commercially available pure Al (Al050, purity is >99.5%) was loaded. After having been held in a vacuum of 0.00133 Pa, the Al loaded particles were heated to 700° C. under the same pressure and kept at the temperature for 3 minutes to 1 hour to make Al impregnate, and then cooled slowly to produce a composite material shown in Table 3. In Table 3 and Tables thereafter, the symbol "○" means that the product was produced, the symbol "x" means that no product was produced, and the symbol "-" means that no data was available.

Figure 2:
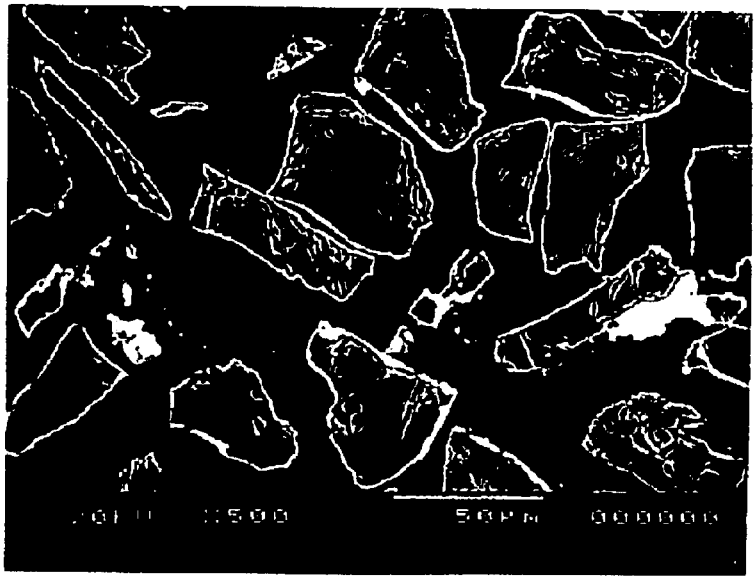
FIG. 2 is a scanning electron microphotograph showing the microstructure of $Al_2O_3$ particles (ground particles) of dispersing agents forming a metal-coated layer (thickness is below 1 $\mu$m and the amount used is below 4 mass %).
Figure 3:
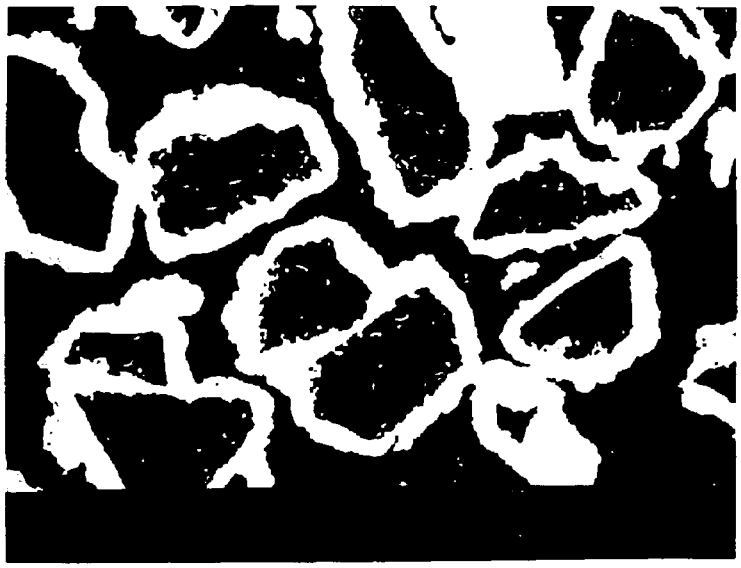
FIG. 3 is a scanning electron microphotograph showing the microstructure of $Al_2O_3$ particles (ground particles) of dispersing agents forming a metal-coated layer (thickness is below 1 $\mu$m and the amount used is below 4 mass %).
Figure 4:
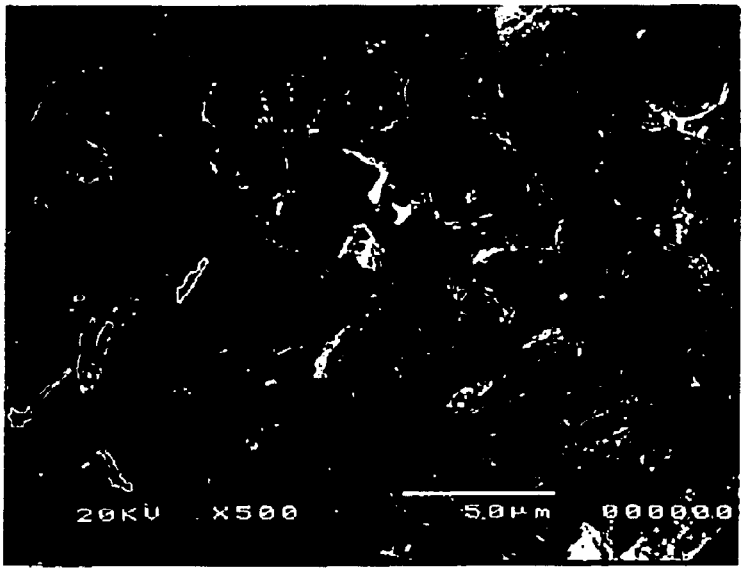
FIG. 4 is a scanning electron microphotograph showing the microstructure of a composite material produced in Example 1, in which material the volume percentage of particles is 40 vol. % and the metal:the intermetallic compound (volume ratio)=10:0.
Figure 5:
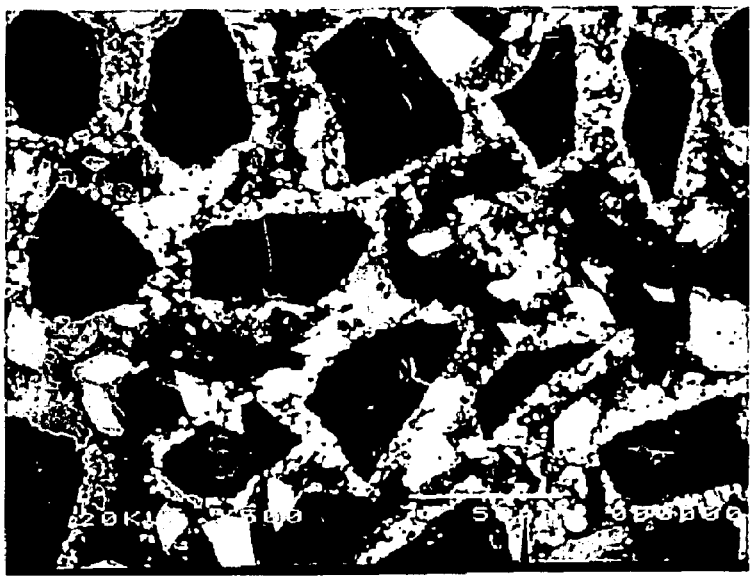
FIG. 5 is a scanning electron microphotograph showing the microstructure of a composite material produced in Example 1, in which material the volume percentage of particles is 40 vol. % and the metal:the intermetallic compound (volume ratio)=5:5.
Figure 6:
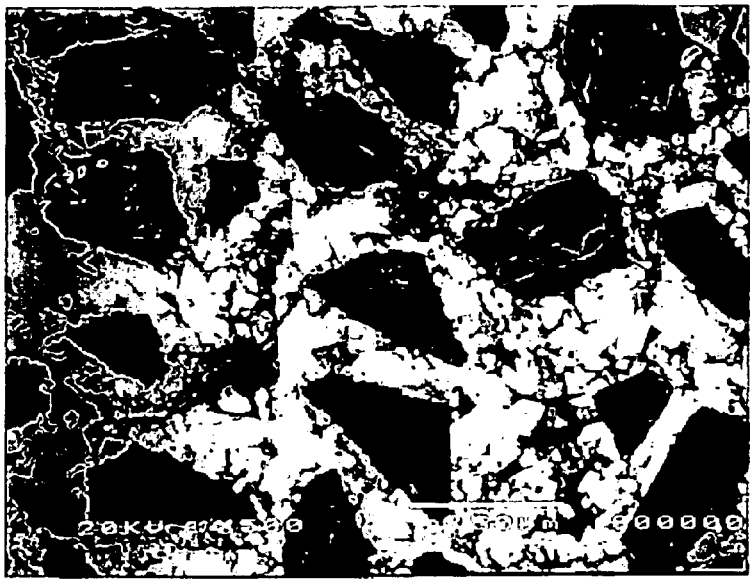
FIG. 6 is a scanning electron microphotograph showing the microstructure of a composite material produced in Example 1, in which material the volume percentage of particles is 40 vol. % and the metal:the intermetallic compound (volume ratio)=2:8.
Figure 7:
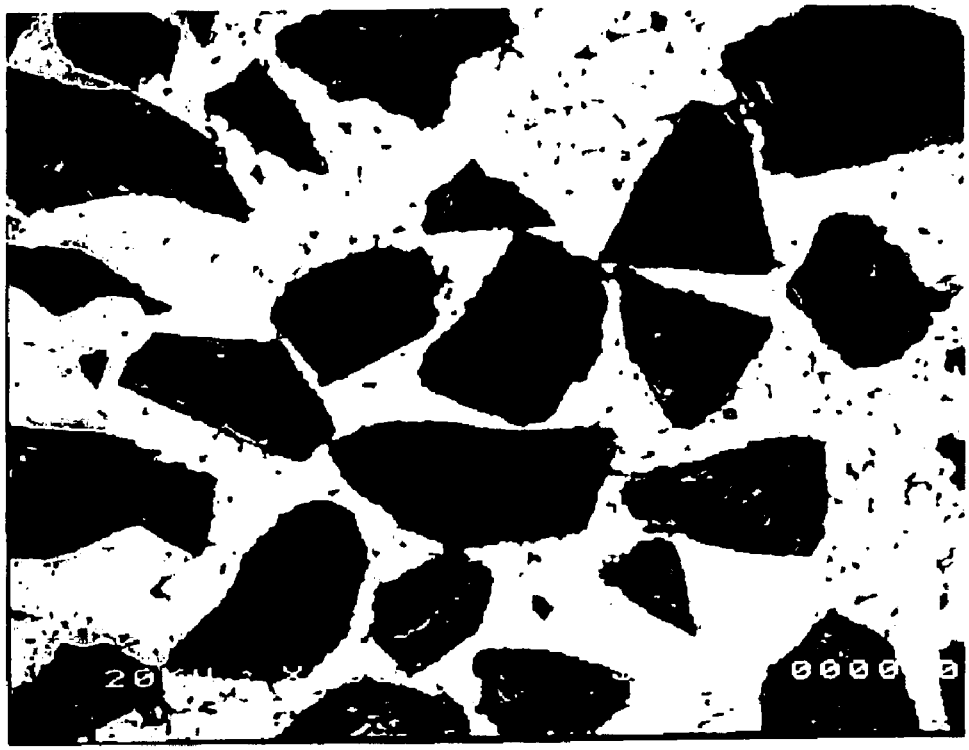
FIG. 7 is a scanning electron microphotograph showing the microstructure of a composite material produced in Example 1, in which material the volume percentage of particles is 40 vol. % and the metal:the intermetallic compound (volume ratio)=0:10.

Further, FIG. 1 is a scanning electron microphotograph showing the microstructure of $Al_2O_3$particles (ground particles) as dispersing agents. And FIG. 2 is a scanning electron microphotograph showing $Al_2O_3$ particles (ground particles) as dispersing agents that formed the metal-coated layer (thickness is below 1 $\mu$m, the amount used: 4 mass %), FIG. 3 is a scanning electron microphotograph showing the microstructure of $Al_2O_3$ particles (ground particles) as dispersing agents that formed the metal-coated layer (thickness is below 1 $\mu$m, the amount used 4 mass %). And FIG. 4 to FIG. 7 are scanning electron microphotographs showing the microstructure of a composite material of 40 vol. % in volume percentage of the particles that was produced in Example 1, and among the photographs FIG. 4 indicates the case of the metal the intermetallic compound (volume ratio)=10:0, FIG. 5 the case of the metal the intermetallic compound (volume ratio)=5:5, FIG. 6 the case of the metal the intermetallic compound (volume ratio)=2:8, and FIG. 7 the case of the metal:the intermetallic compound (volume ratio)=0:10.

Here, the expression of "the metal:the intermetallic compound (volume ratio)" used in the description in the following tables denotes a value calculated from strength of X-ray obtained by subjecting a series of samples prepared by changing the matrix composition to the XRD analysis on the basis of a working curve prepared by the use of a mixed powder containing a metal and an intermetallic compound with volume ratio thereof being previously adjusted to be a predetermined one by the XRD analysis. However, in the present invention, a metallic phase or an intermetallic compound phase, which are inevitably present, sometimes remains because a matrix composition can be freely changed. Therefore, the figure "0" means the one that a peak can hardly be observed by XRD, and to be concrete, it means 1.0% or less in terms of the volume percentage.

TABLE 3

| Volume percentages of particles (vol. %) | Metal:Intermetallic compound (volume ratio) 10:0 | 8:2 | 5:5 | 2:8 | 0:10 | Hybrid type 0:10 |
|---|---|---|---|---|---|---|
| 30 | — | — | — | — | ○ | ○ |
| 40 | — | — | ○ | ○ | ○ | ○ |
| 50 | ○ | ○ | ○ | ○ | ○ | ○ |
| 60 | ○ | ○ | ○ | ○ | x | ○ |
| 70 | ○ | ○ | x | x | x | ○ |

As clearly seen in Table 3 and FIGS. 4 to 7, it was confirmed that through changing the amount of Ni coated to $Al_2O_3$ particles, not only can a composite material be produced in which the matrix has a desired composition, but a composite material can also be produced in which the measured value of bending strength at high temperature is high, that is, a composite material in which whole the matrix is an intermetallic compound (the metal:the intermetallic compound (volume ratio)=0:10).

Example 2

$Al_2O_3$ particles (ground particles) having the average particle size of 47 $\mu$m as dispersing agents and Ni that would become a metal-coated layer were prepared, and a metal-coated layer was formed on the surface of the dispersing agents by electroless plating treatment so that the volume percentage of the particles was 30 to 80 vol. % and the amount of the metal-coated layer was from over 4 to below 42 mass %. Next, a mixture of metal-coated particles and metal powder was produced by mixing Ni powder of 10 $\mu$m in average particle size in the metal-coated layer, and then Al was impregnated in the mixture according to the same operation in Example 1 to produce a composite material. The result is shown as "Hybrid type" in Table 3 similarly to Example 1.

As shown in Table 3, it could be confirmed that a composite material having a volume percentage of the particles of 60 and 70 vol. % (the metal: the intermetallic compound (volume ratio)=0:10), which could not be produced in Example 1, could also be produced.

Example 3

SiC having the average particle size of 54 $\mu$m, AlN of 50 $\mu$m and $Si_3N_4$ particles (ground particles) of 47 $\mu$m as dispersing agents and Ni that would become a metal-coated layer were prepared, and a metal-coated layer was formed on the surface of the dispersing agents by electroless plating treatment so that the volume percentage of the particles was 50 vol. % and the amount of the metal-coated layer was from over 4 to below 42 mass % to produce metal-coated particles. Next, Al was impregnated in the metal-coated particles according to the same operation in Example 1 to produce a composite material. The result is shown in Table 4.

TABLE 4

| Dispersing agents (Volume percentage of particles: 50 vol. %) | Metal:Intermetallic compound (volume ratio) 10:0 | 2:8 | 0:10 |
|---|---|---|---|
| SiC | ○ | ○ | ○ |
| AlN | ○ | ○ | ○ |
| $Si_3N_4$ | ○ | ○ | ○ |

As shown in Table 4, it could be confirmed that even in the case where various kinds of inorganic materials were used as a dispersing agent, any composite material in which the matrix composition was arbitrarily changed could be produced.

Example 4

$Al_2O_3$ having the average particle size of 47 $\mu$m, SiC of 54 $\mu$m, AlN of 50 $\mu$m and $Si_3N_4$ particles (ground particles) of 47 $\mu$m as dispersing agents and Ti and Nb that would become a metal-coated layer were prepared, and a metal-coated layer was formed on the surface of the dispersing agents by sputtering so that the volume percentage of the particles was 50 vol. % and the amount of the metal-coated layer was from over 2 to below 36.5 mass % for Ti and from over 4 to below 53 mass % for Nb to produce metal-coated particles. Next, Al was impregnated in the metal-coated particles according to the same operation in Example 1 to produce a composite material. The result is shown in Table 5.

TABLE 5

| Dispersing agents (Volume percentage of particles: 50 vol. %) | Matrixes | Metal:Intermetallic compound (volume ratio) 10:0 | 2:8 | 0:10 |
|---|---|---|---|---|
| $Al_2O_3$ | Al—Ti | ○ | ○ | ○ |
| | Al—Nb | ○ | ○ | ○ |

TABLE 5-continued

| Dispersing agents (Volume percentage of particles: 50 vol. %) | Matrixes | Metal:Intermetallic compound (volume ratio) 10:0 | 2:8 | 0:10 |
|---|---|---|---|---|
| SiC | Al—Ti | ○ | ○ | ○ |
| | Al—Nb | ○ | ○ | ○ |
| AlN | Al—Ti | ○ | ○ | ○ |
| | Al—Nb | ○ | ○ | ○ |
| $Si_3N_4$ | Al—Ti | ○ | ○ | ○ |
| | Al—Nb | ○ | ○ | ○ |

As shown in Table 5, it could be confirmed that even in the case where Ti and Nb metals other than Ni were used in regard to metals to form a metal-coated layer, any composite material in which the matrix composition was arbitrarily changed could be produced.

Example 5

$Al_2O_3$ particles (ground particles) having the average particle size of 47 μm as dispersing agents and Ni that would become a metal-coated layer were prepared, and a metal-coated layer was formed on the surface of the dispersing agents by electroless plating treatment so that the volume percentage of the particles was 40 to 70 vol. % and the amount of the metal-coated layer was from over 4 to below 86 mass % to produce metal-coated particles. Next, Al was impregnated in the metal-coated particles according to the same operation in Example 1 to produce a composite material (Sample Nos. 1 to 16). The result is shown in Table 6.

example 1), test pieces having a fixed shape were cut off and subjected to the measurement of strength in four-point bending test (JIS R1601) at 400° C. The results are shown in Table 6. Here, the reason for selecting 400° C. as the test temperature is because Al or Al alloys used in impregnation are easily deformed and strength is difficult to be revealed at the temperature zone, and because it becomes possible to quantitatively judge the substitution state of the matrix constituting the obtained composite material.

Furthermore, when a test piece was cut off from each composite material and subjected to thermal analysis with an differential thermal balance analyzer TG-DTA (made by RIGAKU, TG8120 type) under an inert gas atmosphere, peaks of endothermic reactions due to the dissolution reactions of Al existing in the matrixes were confirmed in Sample Nos. 1 to 8, while no endothermic reaction due to the dissolution reaction of Al was measured and only peaks from aluminide intermetallic compounds as product phases after synthesis were measured in Sample Nos. 9 to 16. That is, it was confirmed that concerning Sample Nos. 1 to 8, the composite materials were metal matrix composites in which Al existed in the matrixes, and concerning Sample Nos. 9 to 16, the composite materials were intermetallic matrix composites in which a whole Al in the matrixes was completely replaced with aluminide intermetallic compounds by reaction.

TABLE 6

| | Dispersing agents: Materials | Dispersing agents: Average particle sizes (μm) | Dispersing agents: Volume percentages of particles (vol. %) | Metal-coated layers: Materials | Metal-coated layers: Amount used (mass %) | Metal-coated layers: Thickness ratio with respect to the average particle size of dispersing agent (%) | Metal: Intermetallic compound (volume ratio) | Bending strength at high temperature (400° C., MPa) | Matrixes |
|---|---|---|---|---|---|---|---|---|---|
| Sample No. 1 | $Al_2O_3$ | 47 | 70 | Ni | <4 | <1 | 10:0 | 64 | Al (a trace amount of $Al_3Ni$) |
| Sample No. 2 | $Al_2O_3$ | 47 | 50 | Ni | <4 | <1 | 10:0 | 52 | Al (a trace amount of $Al_3Ni$) |
| Sample No. 3 | $Al_2O_3$ | 47 | 70 | Ni | 10 | 3.0 | 8:2 | 107 | $Al_3Ni$ + Al |
| Sample No. 4 | $Al_2O_3$ | 47 | 50 | Ni | 10 | 3.0 | 8:2 | 93 | $Al_3Ni$ + Al |
| Sample No. 5 | $Al_2O_3$ | 47 | 60 | Ni | 24 | 7.0 | 5:5 | 178 | $Al_3Ni$ + Al |
| Sample No. 6 | $Al_2O_3$ | 47 | 50 | Ni | 24 | 7.0 | 5:5 | 162 | $Al_3Ni$ + Al |
| Sample No. 7 | $Al_2O_3$ | 47 | 60 | Ni | 33 | 10 | 2:8 | 254 | $Al_3Ni$ + Al |
| Sample No. 8 | $Al_2O_3$ | 47 | 50 | Ni | 33 | 10 | 2:8 | 233 | $Al_3Ni$ + Al |
| Sample No. 9 | $Al_2O_3$ | 47 | 50 | Ni | 42 | 14 | 0:10 | 362 | $Al_3Ni$ |
| Sample No. 10 | $Al_2O_3$ | 47 | 40 | Ni | 42 | 14 | 0:10 | 321 | $Al_3Ni$ |
| Sample No. 11 | $Al_2O_3$ | 47 | 40 | Ni | 48 | 17 | 0:10 | 349 | $Al_3Ni$ + $Al_3Ni_2$ |
| Sample No. 12 | $Al_2O_3$ | 47 | 40 | Ni | 57 | 21 | 0:10 | 372 | $Al_3Ni_2$ |
| Sample No. 13 | $Al_2O_3$ | 47 | 40 | Ni | 61 | 23 | 0:10 | 461 | $Al_3Ni_2$ + NiAl |
| Sample No. 14 | $Al_2O_3$ | 47 | 40 | Ni | 69 | 28 | 0:10 | 638 | NiAl |
| Sample No. 15 | $Al_2O_3$ | 47 | 40 | Ni | 83 | 38 | 0:10 | 512 | NiAl + $Ni_3Al$ |
| Sample No. 16 | $Al_2O_3$ | 47 | 40 | Ni | 86 | 40 | 0:10 | 315 | $Ni_3Al$ |
| Comparative example 1 | — | — | — | — | — | — | — | <50 | Commercially available materials (Nos. 2000, 6000, 7000 series and others) |

Further, concerning obtained composite materials (Sample Nos. 1 to 16), and Al alloys of No. 2000, 6000, and 7000 series that are commercially available (Comparative As shown in Table 6, it could be confirmed that the composition of the matrix formed could be arbitrarily changed from an Al-rich compound to an aluminide intermetallic compound by controlling the amount of the metal-coated layer. Further, it could also be confirmed that any of the composite material produced had sufficient bending strength at high temperature.

(The Measurements and Tests of Various Kinds of Physical Property Values on Composite Materials Produced)

1. Measurements of physical property values (Composite materials of $Al_2O_3$/Al—Ni series).

According to the method in Example 1, composite materials in which the volume percentage of the particles was 40 to 70 vol. % and the metal the intermetallic compound (volume ratio)=10:0, 2:8, 0:10 were produced using $Al_2O_3$ particles (ground particles) having the average particle size of 47 $\mu$m as dispersing agents and Ni as a metal-coated layer. Then, thermal conductivity, thermal expansion coefficients and fracture toughness values were measured on each composite material. The results are shown in Tables 7, 8 and 9. Further, the measurement methods of the above described each physical property value are as shown in the following. And, "-" used in the description in each table means that no production was conducted, and "x" means that no composite material could be produced (the production was impossible).

[The Measurement of Thermal Conductivity]:

After samples having a fixed shape were cut off from obtained composite materials, thermal conductivity was measured on the samples with a thermal constant measuring device (made by Shinku Riko Co., Ltd., TC-7000) according to Laser Flash Process. The measurement was conducted at room temperature.

[The Measurement of Thermal Expansion Coefficients]:

After samples having a fixed shape were cut off from obtained composite materials, thermal expansion coefficients of the samples were measured at room temperature to 800° C. in the atmosphere of Ar gas with a thermal expansion meter (made by Mac Science Co., Ltd., TD-5000S).

[The Measurement of Fracture Toughness Values]:

After samples having a fixed shape were cut off from obtained composite materials, strength in four-point bending test was measured on the samples and fracture toughness values were calculated according to Chevron notch method.

TABLE 7

| Volume percentages of particles (vol. %) | Metal:Intermetallic compound (volume ratio) 10:0 | 2:8 | 0:10 |
|---|---|---|---|
| | Thermal conductivity (W/mK) | | |
| 40 | — | — | 33 |
| 50 | 73 | 41 | 31 |
| 60 | — | 43 | x |
| 70 | 49 | x | x |

TABLE 8

| Volume percentages of particles (vol. %) | Metal:Intermetallic compound (volume ratio) 10:0 | 2:8 | 0:10 |
|---|---|---|---|
| | Thermal expansion coefficients (ppm/K) | | |
| 40 | — | — | 11.7 |
| 50 | 15.8 | 12.5 | 10.4 |
| 60 | — | 11.2 | x |
| 70 | 13.4 | x | x |

TABLE 9

| Volume percentages of particles (vol. %) | Metal:Intermetallic compound (volume ratio) 10:0 | 2:8 | 0:10 |
|---|---|---|---|
| | Fracture toughness values ($Ma \cdot m^{1/2}$) | | |
| 40 | — | — | 9.4 |
| 50 | 19.3 | 15.4 | 8.2 |
| 60 | — | 13.7 | x |
| 70 | 16.1 | x | x |

As shown in Tables 7 to 9, it could be confirmed that in composite materials produced by conducting the present invention, their composite material properties could be made variable by changing the ratio of the metal:the intermetallic compound (volume ratio) or the volume percentage of particles in the matrix.

2. Measurements of Physical Property Values (Composite Materials of SiC, AlN, $Si_3N_4$/Al—Ni).

According to the method in Example 3, composite materials in which the volume percentage of the particles was 50 vol. % and the metal the intermetallic compound (volume ratio)=10:0, 2:8, 0:10 were produced using SiC having the average particle size of 54 $\mu$m, AlN of 50 $\mu$m and $Si_3N_4$ particles (ground particles) of 47 $\mu$m as dispersing agents and Ni as a metal-coated layer. Then, high-temperature strength, thermal conductivity, and thermal expansion coefficients were measured on each composite material. The results are shown in Table 10. Further, the measurement methods of the above described each physical property value are as described above. And, "-" used in the description in the table means that no production was conducted.

TABLE 10

| Dispersing agents | SiC | | | AlN | | | $Si_3N_4$ | | |
|---|---|---|---|---|---|---|---|---|---|
| Metal:Intermetallic compound (volume ratio) | 10:0 | 2:8 | 0:10 | 10:0 | 2:8 | 0:10 | 10:0 | 2:8 | 0:10 |
| High-temperature strength (MPa, 400° C.) | 61 | 247.0 | 378 | 58 | 221 | 356 | 67 | 251 | 392 |
| Thermal conductivity (W/mK) | 193 | 126 | 114 | 172 | 109 | 97 | — | — | — |
| Thermal expansion coefficients (ppm/K) | 11.2 | 9.3 | 8.6 | 12.4 | 10.7 | 9.1 | 10.9 | 8.7 | 7.4 |

As shown in Table 10, it was confirmed that in composite materials produced by conducting the present invention, their optional composite material properties could be obtained by not only changing the ratio of the metal:the intermetallic compound in the matrix (volume ratio) but selecting the kind of dispersing agents.

3. Oxidation Resistance Tests and Abrasion Resistance Tests (Composite Materials of $Al_2O_3$/Al—Ni Series).

According to the method in Example 1, composite materials in which the volume percentage of the particles was 50 vol. % and the metal:the intermetallic compound (volume ratio)=10:0, 2:8, 0:10 were produced using $Al_2O_3$ particles (ground particles) having the average particle size of 47 $\mu$m as dispersing agents and Ni as a metal-coated layer. Then, oxidation resistance tests, abrasion resistance tests were conducted on each composite material. The results are shown in Tables 11 and 12. Further, the measurement methods of the above described each physical property value are as shown in the following. And, concerning the abrasion resistance test, the same test as that for the composite materials was conducted on commercially available Al alloy (AC8A), which is excellent in abrasion resistance due to the presence of an eutectic Si phase among Al alloys, as Comparative example 2.

[Oxidation Resistance Tests]:

Obtained composite materials were held at 900° C. for 100 hours in the air, and the weight changes of the samples before and after the test were measured.

[Abrasion Resistance Tests]:

Samples having a fixed shape were cut off from obtained composite materials and the abrasion resistance tests were conducted on the samples with an abrasion testing machine (made by Shinko Engineering Co., Ltd.) at room temperature.

TABLE 11

| | Metal:Intermetallic compound (volume ratio) | | |
|---|---|---|---|
| Oxidation resistance test | 10:0 | 2:8 | 0:10 |
| Weight change (mg/cm$^2$) | Partially | dissolved | 0.2 |

TABLE 12

| | Metal:Intermetallic compound (volume ratio) | | | Comparative example 2 |
|---|---|---|---|---|
| Abrasion resistance test | 10:0 | 2:8 | 0:10 | Al alloy (AC8A) |
| Abrasion loss (mm$^3$) | 114 | 47 | 11 | 740 |

As shown in Tables 11 and 12, in composite materials produced by practicing the present invention, because the matrix is changed from Al having low melting point to an aluminide intermetallic compound by making the ratio of the metal:the intermetallic compound in the matrix (volume ratio) to be 0:10 in the oxidation resistance test, the composite materials did not cause partial dissolving and had a little change in weight. And it was confirmed that the abrasion loss of the composite material was lower than that of commercially available Al alloys in the abrasion resistance test and further the abrasion resistance was more improved by the intermetallic compound in the matrix.

Examples 6 to 8

A total of 3 kinds of dispersing agents of $Al_2O_3$particles (ground particles) having the average particle size of 47 $\mu$m as solid particles, and of hollow particles composed of shirasu balloon (manufactured by Ube Material Industries) having the average shell thickness of about 1 $\mu$m or less and fly ash balloon (manufactured by Taiheiyo Cement) having the average shell thickness of about 5–10 $\mu$m or less, and Ni that would become a metal-coated layer were prepared, and a metal-coated layer was formed on the surface of the dispersing agents by electroless plating treatment so that the volume percentage of the particles was 50 vol. % and the amount of the metal-coated layer was 4 mass % to produce metal-coated particles. Next, the metal-coated particles were impregnated with Al according to the same operation in Example 1 to produce a composite material (Examples 6 to 8).

Figure 8:
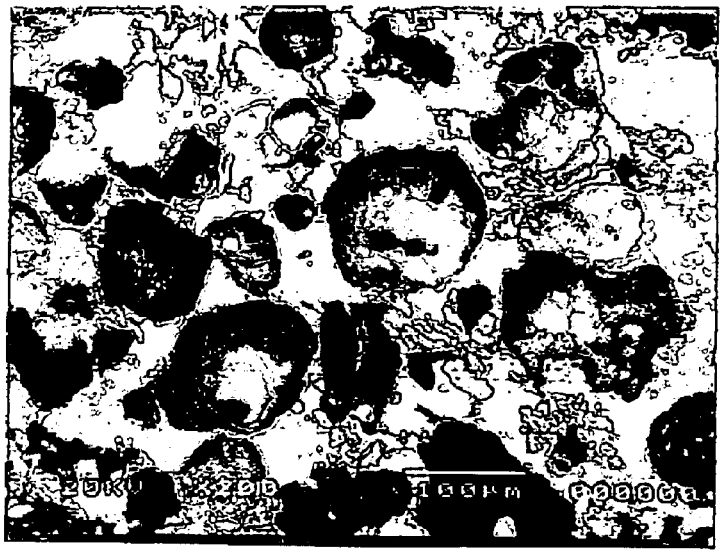
FIG. 8 is a scanning electron microphotograph showing the microstructure of a composite material produced in Example 7, with magnification of 200.
Figure 9:
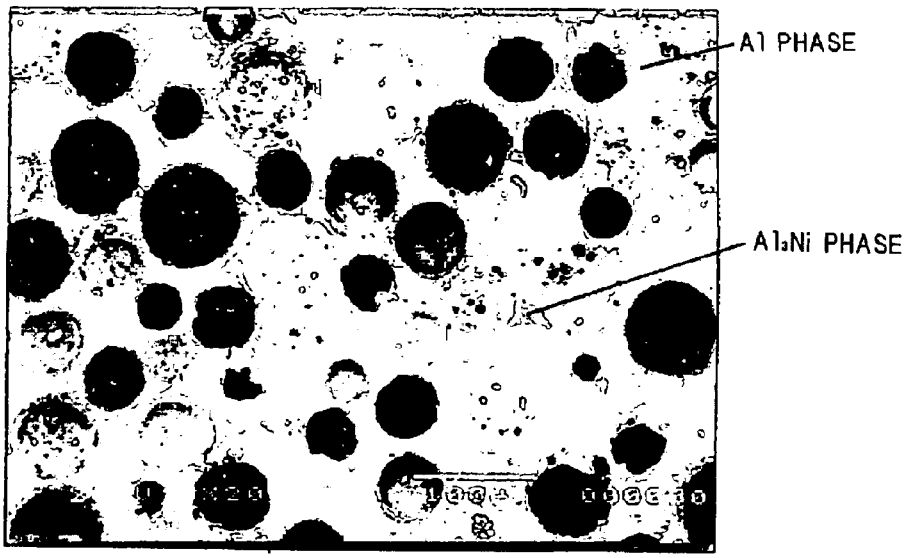
FIG. 9 is a scanning electron microphotograph showing the microstructure of a composite material produced in Example 8, with magnification of 200, respectively.

A sample having a fixed shape was cut off from each of obtained composite materials (Sample Nos. 1 to 16) and commercially available Al alloy (A5052, Comparative example 1), and the measurements of density, specific elastic modulus and thermal expansion coefficients were conducted on the samples. Further, the measurement of density was conducted according to the Archimedes method, and the measurement of a specific elastic modulus was conducted by the method shown in the following. Furthermore, FIGS. 8, and 9 are scanning electron microphotographs showing the microstructure of composite materials in Examples 7 and 8, with magnification of 200, respectively.

[Calculation of Specific Elastic Modulus]:

Young's modulus was measured by the aforementioned four-point bending test, and the obtained value was divided by the density of the sample employed to calculate a specific elastic modulus.

TABLE 13

| | Dispersing agents | | The shell thickness of | Density | Specific elastic moduli | Thermal expansion coefficients |
|---|---|---|---|---|---|---|
| | Materials | Shapes | hollow particles | (g/cm$^3$) | (GPa/(g · cm$^3$)) | (ppm/K) |
| Example 6 | | Solid particles | — | 3.1 | 45 | 13 |
| Example 7 | | Hollow particles | < about 1 $\mu$m | 1.1 | 12 | 22 |
| Example 8 | | Hollow particles | About 5 to 10 $\mu$m | 1.3 | 36 | 18 |
| Comparative example 3 | Al alloy (A5052) | — | — | 2.7 | 22 | 26 |

As shown in Table 13, it could be confirmed that the density of the porous composite materials concerned with the present invention and produced using hollow particles as dispersing agents (Examples 7 and 8) was about half as high as that of the composite material produced using Al alloy (Comparative example 3). Further, it became clear that the specific elastic modulus of the porous composite material produced using hollow particles of about 5 to 10 μm in the average shell thickness (Example 8) was significantly increased, compared to that of the porous composite material produced using hollow particles of below about 1 μm in the average shell thickness (Example 7). Furthermore, the value of the thermal expansion coefficient thereof was found to be lowered to the level equal to that of the case wherein the solid particles were used (Example 6).

Examples 9 and 10

A dispersing agent of hollow particles composed of fly ash balloon (manufactured by Taiheiyo Cement) having the average particle size of about 100 μm and the average shell thickness of about 5–10 μm or less, used in Example 8 where the specific elastic modulus was remarkably increased, and Ni that would become a metal-coated layer were prepared. Then, two kinds of metal-coated particles were produced by forming a metal-coated layer on the surface of the dispersing agent by electroless plating treatment in the amounts of 24 mass % and 42 mass %, respectively, with adjusting the volume percentage of the particles to 50 vol. % therein. Next, thus obtained metal-coated particles were impregnated with Al according to the same operation in Example 1 to produce a composite material (Examples 9, 10).

As a result, it was found that porous composite material having a matrix showing from a multi-phase of $Al+Al_3Ni$ (Example 9) to a single phase of $Al_3Ni$ (Example 10) can be synthesized, even in the case of using hollow particles.

As described above, according to the production method of the present invention, because metal-coated layers are formed on the surface of various kinds of dispersing agents, the reaction of the metal-coated layer with molten Al is caused. For this reason, composite materials can be produced at low temperature and under non-pressurized condition compared to the conventional production method. Further, it is possible that the matrix in a composite material is properly set to be any of Al, a mixture of Al and an aluminide intermetallic compound, or an aluminide intermetallic compound by synthesizing an aluminide intermetallic compound in situ or controlling the thickness and the amount used of a metal-coated layer. Moreover, since it is possible to make a near net shape in consideration of the shape of an end product, the production processes can be reduced and the reduction in the production cost is achieved at the same time. On the other hand, the composite material of the present invention that is produced according to the above described production method is a composite material having the desired physical properties.

What is claimed is:

1. A production method of a composite material composed of a dispersing agent and a matrix, which comprises:

forming a metal-coated layer on the surface of said dispersing agent to prepare a metal-coated dispersing agent, filling said metal-coated dispersing agent in a jig prepared in a fixed shape, and then causing a reaction of said metal-coated layer with molten Al by impregnating said filled metal-coated dispersing agent with said molten Al to form said matrix.

2. The production method of a composite material according to claim 1, wherein said metal-coated layer is composed of Ni, has a thickness of below 1% with respect to the average particle size of the dispersing agent, and is formed using below 4 mass % of Ni with respect to the total amount of said molten Al and said Ni, and the whole of the matrix is made of Al.

3. The production method of a composite material according to claim 1, wherein said metal-coated layer is composed of Ni, has a thickness of 1% or more to below 8% with respect to the average particle size of the dispersing agent, and is formed using 4 mass % or more to below 42 mass % of Ni with respect to the total amount of said molten Al and said Ni, and the whole of the matrix is made of a mixture of Al and an aluminide intermetallic compound.

4. The production method of a composite material according to claim 1, wherein said metal-coated layer is composed of Ti, has a thickness of 8% or more to 26% or less with respect to the average particle size of the said dispersing agent, and is formed using 42 mass % or more to 87.8 mass % or less of Ni with respect to the total amount of said molten Al and said Ni, and the whole of the matrix is made of an aluminide intermetallic compound.

5. The production method of a composite material according to claim 1, wherein a said metal-coated layer is composed of Ti, has a thickness of below 1% with respect to the average particle size of the dispersing agent, and is formed using below 2 mass % of Ti with respect to the total amount of said molten Al and said Ti, and the whole of the matrix is made of Al.

6. The production method of a composite material according to claim 1, wherein said metal-coated layer is composed of Ti, has a thickness of 1% or more to below 12% with respect to the average particle size of the dispersing agent, and is formed using 2 mass % or more to below 36.5 mass % of Ti with respect to the total amount of said molten Al and said Ti, and the whole of the matrix is made of a mixture of Al and an aluminide intermetallic compound.

7. The production method of a composite material according to claim 1, wherein said metal-coated layer is composed of Ti, has a thickness of 12% or more to 25% or less with respect to the average particle size of the dispersing agent, and is formed using 36.5 mass % or more to 86 mass % or less of Ti with respect to the total amount of molten Al and said Ti, and the whole of the matrix is made of an aluminide intermetallic compound.

8. The production method of a composite material according to claim 1, wherein said metal-coated layer is composed of Nb, has a thickness of below 1% with respect to the average particle size of the dispersing agent, and is formed using below 4 mass % of Nb with respect to the total amount of molten Al and said Nb, and the whole of the matrix in made of Al.

9. The production method of a composite material according to claim 1, wherein said metal-coated layer is composed of Nb, has a thickness of 1% or more to below 12% with respect to the average particle size of the dispersing agent, and is formed using 4 mass % or more to below 53 mass % of Nb with respect to the total amount of molten Al and said Nb, and the whole of the matrix is made of a mixture of Al and an aluminide intermetallic compound.

10. The production method of a composite material according to claim 1, wherein said metal-coated layer is composed Nb, has a thickness of 12% or more to 25% or less with respect to the average particle size of the dispersing agent, and is formed using 53 mass % or more to 92.4 mass % or less of Nb with respect to the total amount of molten Al and said Nb, and the whole of the matrix is made of an aluminide intermetallic compound.

11. The production method of a composite material according to claim 1, wherein said metal-coated layer is formed by a method selected from a group consisting of electroless plating, CVD, ion plating as PVD, sputtering, and vacuum evaporation.

12. The production method of a composite material according to claim 1, wherein the dispersing agent is at least one inorganic material selected from the group consisting of fibers, particles, whiskers, hollow particles, porous bodies with open pores, and porous bodies with closed pores.

13. The production method of a composite material according to claim 12, wherein said hollow particles have a shell thickness of 0.1 to 30 $\mu$m.

14. The production method of a composite material according to claim 12, wherein said inorganic material is one selected from the group consisting of $Al_2O_3$, AlN, SiC, and $Si_3N_4$.

15. The production method of a composite material according to claim 14, wherein the volume percentage of the dispersing agent in the composite material is 20 to 80%.

16. The production method of a composite material according to claim 1, wherein after the metal-coated dispersing agent has been prepared, prior to filling said metal-coated dispersing agent into the jig, metal powder is mixed with said metal-coated dispersing agent.

17. The production method of a composite material according to claim 16, wherein said metal powder has an average size of 0.05 to 80% with respect to the average particle size of the dispersing agent.

18. A composite material comprising a dispersing agent and a matrix, wherein a metal-coated dispersing agent is prepared by forming a metal-coated layer on the surface of said dispersing agent, said metal-coated dispersing agent is filled in the jig prepared in a fixed shape, and a reaction of said metal-coated layer with molten Al is caused by impregnating said filled metal-coated dispersing agent with said molten Al to form said matrix.

19. The composite material according to claim 18, wherein the metal-coated layer is Ni, the amount of said Ni used is below 4 mass % with respect to the total amount of molten Al and said Ni, the thickness of said metal-coated layer is below 1% with respect to the average particle size of the dispersing agent, and the whole of the matrix is Al.

20. The composite material according to claim 18, wherein the metal-coated layer is Ni, the amount of said Ni used is 4 mass % or more to below 42 mass % with respect to the total amount of molten Al and said Ni, the thickness of said metal-coated layer is 1% or more to below 8% with respect to the average particle size of the dispersing agent, and the whole of the matrix is a mixture of Al and an aluminide intermetallic compound.

21. The composite material according to claim 18, wherein the metal-coated layer is Ni, the amount of said Ni used is 42 mass % or more to 87.8 mass % or less with respect to the total amount of molten Al and said Ni, the thickness of said metal-coated layer is 8% or more to 26% or less with respect to the average particle size of the dispersing agent, and the whole of the matrix is an aluminide intermetallic compound.

22. The composite material according to claim 18, wherein the metal-coated layer is Ti, the amount of said Ti used is below 2 mass % with respect to the total amount of molten Al and said Ti, the thickness of said metal-coated layer is below 1% with respect to the avenge particle size of the dispersing agent, and the whole of the matrix is Al.

23. The composite material according to claim 18, wherein the metal-coated layer is Ti, the amount of said Ti used is 2 mass % or more to below 36.5 mass % with respect to the total amount of molten Al and said Ti, the thickness of said metal-coated layer is 1% or more to below 12% with respect to the average particle size of the dispersing agent, and the whole of the matrix is a mixture of Al and an aluminide intermetallic compound.

24. The composite material according to claim 18, wherein the metal-coated layer is Ti, the amount of said Ti used is 36.5 mass % or more to 86 mass % or less with respect to the total amount of molten Al and said Ti, the thickness of said metal-coated layer is 12% or more to 25% or less with respect to the average particle size of the dispersing agent, and the whole of the matrix is an aluminide intermetallic compound.

25. The composite material according to claim 18, wherein the metal-coated layer is Nb, the amount of said Nb used is below 4 mass % with respect to the total amount of molten Al and said Nb, the thickness of said metal-coated layer is below 1% with respect to the average particle size of the dispersing agent, and the whole of the matrix is Al.

26. The composite material according to claim 18, wherein the metal-coated layer is Nb, the amount of said Nb used is 4 mass % or more to below 53 mass % with respect to the total amount of molten Al and said Nb, the thickness of said metal-coated layer is 1% or more to below 12% with respect to the average particle size of the dispersing agent, and the whole of the matrix is a mixture of Al and an aluminide intermetallic compound.

27. The composite material according to claim 18, wherein the metal-coated layer is Nb, the amount of said Nb used is 53 mass % or more to 92.4 mass % or less with respect to the total amount of molten Al and said Nb, the thickness of said metal-coated layer is 12% or more to 25% or less with respect to the average particle size of the dispersing agent, and the whale of the matrix is an aluminide intermetallic compound.

28. The composite material according to claim 18, wherein the dispersing agent is at least one inorganic material selected from the group consisting of fibers, particles, whiskers, hollow particles, porous bodies with open pores, and porous bodies with closed pores.

29. The composite material according to claim 28, wherein said hollow particles have a shell thickness of 0.1 to 30 $\mu$m.

30. The composite material according to claim 28, wherein said inorganic material is at least one selected from rite group consisting of $Al_2O_3$, AlN, SiC, and $Si_3N_4$.

31. The composite material according to claim 18, wherein the volume percentage of the dispersing agent in the composite material is 20 to 80%.

32. The composite material according to claim 31, wherein after said metal-coated dispersing agent has been prepared, prior to filling said metal-coated dispersing agent into the jig, metal powder is mixed with said metal-coated dispersing agent.

33. The composite material according to claim 32, wherein the average particle size of said metal powder is 0.05 to 80% with respect to the average particle size of the dispersing agent.

* * * * *

UNITED STATES PATENT AND TRADEMARK OFFICE

CERTIFICATE OF CORRECTION

PATENT NO. : 6,746,507 B2
DATED : June 8, 2004
INVENTOR(S) : Masayuki Shinkai et al.

It is certified that error appears in the above-identified patent and that said Letters Patent is hereby corrected as shown below:

Column 26,
Line 18, replace “Ti” with -- Ni --
Line 25, delete “a”

Column 28,
Line 1, replace “avenge” with -- average --
Line 39, replace “whale” with -- whole --

Signed and Sealed this

Twenty-third Day of November, 2004

JON W. DUDAS
*Director of the United States Patent and Trademark Office*